US006669836B2

(12) United States Patent
Keppler et al.

(10) Patent No.: US 6,669,836 B2
(45) Date of Patent: Dec. 30, 2003

(54) MOLTEN SALT ELECTROLYSIS OF ALKALI METALS

(75) Inventors: Stephen John Keppler, Ransomville, NY (US); Thomas A. Messing, Ransomville, NY (US); Kevin Bernard Proulx, East Amherst, NY (US); Davendra Kumar Jain, Grand Island, NY (US)

(73) Assignee: New Mexico Tech Research Foundation, Socorro, NM (US)

( * ) Notice: Subject to any disclaimer, the term of this patent is extended or adjusted under 35 U.S.C. 154(b) by 228 days.

(21) Appl. No.: 09/861,054

(22) Filed: May 18, 2001

(65) Prior Publication Data

US 2001/0045365 A1 Nov. 29, 2001

Related U.S. Application Data

(60) Provisional application No. 60/205,755, filed on May 19, 2000.

(51) Int. Cl.[7] ..... C25C 3/02

(52) U.S. Cl. ..... 205/406; 205/407; 205/408; 205/409

(58) Field of Search ..... 205/406–409

(56) References Cited

U.S. PATENT DOCUMENTS

| | | | | |
|---|---|---|---|---|
| 1,501,756 A | | 7/1924 | Downs | |
| 2,850,442 A | | 9/1958 | Cathcart et al. | |
| 3,119,756 A | | 1/1964 | Thomas | |
| 4,187,155 A | * | 2/1980 | de Nora et al. | 205/383 |
| 5,015,343 A | * | 5/1991 | LaCamera et al. | 205/354 |
| 5,118,396 A | * | 6/1992 | Claus et al. | 205/363 |

OTHER PUBLICATIONS

"Sodium, Its Manufacture, Properties and Uses", American Chemical Society Monograph Series, Reinhold Publishing Corp., New York (1956), vol. 22, p. 327 to 354, pp 29–34, (no month).

Kirk–Othmer Encyclopedia of Chemical Technology, 4$^{th}$ Ed., Wiley/Interscience, New York (1997), vol. 22, pp 327–354, (no month).

Ullman's Encyclopedia of Industrial Chemistry, 5$^{th}$ Ed., Vo. A24, VCH Verlagsgesellschaft, Germany, pp. 284–288 (1993), (no month).

* cited by examiner

*Primary Examiner*—Donald R. Valentine
(74) *Attorney, Agent, or Firm*—R W Becker & Associates; R W Becker

(57) ABSTRACT

An electrolysis process is provided which comprises carrying out the process in an electrolyte that comprises an alkali metal halide and a strontium halide. The process can be carried out at a current density in the range of from about 7 to about 10 kA/m$^2$.

8 Claims, No Drawings

MOLTEN SALT ELECTROLYSIS OF ALKALI METALS

This application claims benefit under USC 119(e) of provisional application No. 60/205,755 filed May 19, 2000.

FIELD OF THE INVENTION

This invention relates to a molten salt electrolysis process for producing an alkali metal using a binary alkali metal halide and strontium halide molten salt electrolyte.

BACKGROUND OF THE INVENTION AND PRIOR ART

The alkali metals, sodium, potassium, lithium, rubidium, cesium and francium are not found in elemental form in nature because of their high reactivity which causes them to combine with other elements to form various compounds. Electrolytic reduction is necessary to produce an alkali metal in its elemental form. The currently used process, on a world-wide basis, is the so-called "DOWNS PROCESS", which was introduced in the early part of the $20^{th}$ century for the production of sodium and lithium from their chlorides (Marshall Sittig, *Sodium, Its Manufacture, Properties and Uses*, American Chemical Society Monograph Series, Reinhold Published Corp., New York; Chapman & Hall, Ltd., London (1956) and Kirk-Othmer Encyclopedia of Chemical Technology, $4^{th}$ Edition, Wiley/Interscience, New York (1997), Vol. 22, p. 327 to 354). The Downs Process uses a molten salt electrolyte consisting of a mixture of NaCl, $CaCl_2$, and $BaCl_2$ in order to reduce the melting temperature of the electrolyte to less than 600° C. This makes the process more practical compared to using pure NaCl which has a much higher melting point of about 800° C. The most important of the alkali metals, for industrial uses, is sodium. Sodium metal produced by the conventional Downs Process contains small amounts of calcium metal, which is co-deposited with the sodium at the cathode during electrolysis because the decomposition potential of calcium is close to that of sodium. Fairly elaborate and costly cooling/precipitation/filtration procedures are necessary to remove the calcium from the sodium metal produced by the conventional Downs Process. These purification steps remove practically all of the barium and most of the calcium. However, a significant amount of calcium is retained in the commercially produced sodium even after the purification process. Typical commercial sodium metal contains about 200 to 400 parts per million by weight (ppm) of calcium. For some applications (particularly nuclear, but also some chemical and electronic uses), an essentially calcium-free sodium is required. There are chemical routes to further purify sodium metal but these routes are extremely expensive.

Electrolytes which eliminated calcium and, therefore, produced calcium-free sodium were developed some years ago. These electrolytes are based on ternary and quaternary compositions containing NaCl, $SrCl_2$, $BaCl_2$ (ternary) and/or NaCl, $SrCl_2$, $BaCl_2$, NaF (quaternary) in near-eutectic proportions having melting temperatures of about 550 to 560° C. (U.S. Pat. No. 2,850,442). A binary NaCl/$SrCl_2$, electrolyte was also developed for the elimination of calcium from the sodium metal product (U.S. Pat. No. 3,119,756).

These electrolytes can be used in the standard Downs-type electrolytic cells without significant cell modification and/or change in operating conditions (same electrolyte/cell operating temperature of about 600° C. and same cell voltage of about 7.0 to 7.5 V) because the melting temperature of these compositions is about the same as that for the standard NaCl/$CaCl_2$,$BaCl_2$ electrolyte. Current efficiency of cells operated with the ternary strontium electrolyte "bath" are in the range of 85% to 89%, similar to the standard NaCl/$CaCl_2$,/$BaCl_2$ bath. The quaternary bath can give somewhat higher current efficiencies but has the disadvantage that it attacks the brick lining of the electrolytic cells. Sodium made with the strontium-containing electrolytes is near calcium-free, but contains about 1000 ppm strontium and barium, which can be removed to low levels by a simpler conventional filtration process.

In the above electrolyte systems, cell operating temperatures are typically about 600° C. when operating at high current densities in the order of 5 to 6 kA/$m^2$. Current efficiency is reduced at higher temperatures, for example when operating at current densities higher than 5 to 6 kA/$m^2$, due to formation of "sodium fog" (emulsification of sodium in the electrolyte). This causes sodium losses and, therefore, losses in current efficiency when operating at higher current densities and temperatures above about 600° C. in a Downs Process with the standard NaCl/$CaCl_2$,/$BaCl_2$ electrolyte. When in the form of sodium fog, sodium can partially migrate to the anode where the sodium is re-oxidized or reacts with chlorine to form NaCl. Sodium fog can also migrate to the surface of the molten electrolyte, which is exposed to air, whereupon sodium can also become re-oxidized.

Therefore, it is highly desirable to develop a process that is capable of operating at high current densities while producing substantially calcium-free sodium without a large increase in operating costs. An advantage of the present invention is the substantial elimination of calcium in the alkali metal product and increased electrolysis cell output without the need for substantial change in the cell design.

SUMMARY OF THE INVENTION

The present invention provides a molten salt electrolysis process for producing an alkali metal comprising carrying out the process using a binary electrolyte comprising an alkali metal halide and strontium halide, wherein the process is carried out at a high current density.

DETAILED DESCRIPTION OF THE INVENTION

The present invention provides a process for producing an alkali metal by electrolysis from a binary molten salt electrolyte comprising an alkali metal halide and a strontium halide. In particular, the process is carried out at a high current density. The term "high current density" refers to about 7 to about 10, preferably about 7 to about 8, kA/$m^2$. Current density is defined as the current in Amperes per unit area of effective electrode surface area. Increasing the current density on a given cell design can be carried out by increasing the current through the cell. For a cell of given design the electrode area is constant and an increase in current density means an increase in total current and, therefore, a corresponding increase in sodium production per unit time (provided there is no change in current efficiency).

The process of the invention can be carried out at any suitable temperature that can achieve an increase in sodium production per unit time. Generally, the temperature can be in the range of from about 605 to about 625° C.

Any alkali metal halides can be used in the invention. The term "alkali metal" refers to lithium, sodium, potassium, rubidium, cesium, francium, or combinations of two or more thereof. The presently preferred alkali metal halide is sodium chloride for it is widely used in electrolysis and sodium produced therefrom is commercially important. Similarly, strontium chloride is the preferred strontium halide.

The weight ratio of alkali metal halide to strontium halide can be any ratio so long as the ratio can produce a high purity alkali metal having calcium levels of less than about 50 ppm, barium levels of less than about 30 ppm, and strontium levels of less than about 600 ppm, preferably calcium levels of less than about 20 ppm, barium levels of less than about 10 ppm, and strontium levels of less than about 300 ppm. Generally, the ratio can be in the range of from about 35 NaCl/65 $SrCl_2$ to about 19 NaCl/81$SrCl_2$. For example, a binary electrolyte composition can contain 27 weight % NaCl and about 73 weight % $SrCl_2$. Impurities in the electrolyte are preferably kept to less than about 2% by weight.

The process of the present invention for molten salt electrolysis of alkali metals uses a Downs cell design to carry out the process, originally disclosed in U.S. Pat. No. 1,501,756. A detailed description of this cell is given in Ullmann's Encyclopedia of Industrial Chemistry, $5^{th}$ Ed., Vol. A24, VCH Verlagsgesellschaft, Germany, pp. 284–288 (1993). The pertinent portions of these documents are hereby incorporated into this specification by this reference thereto.

The ensuing discussion provides an example of a Downs cell useful in the present invention. However, it should be recognized that other designs based on a Downs cell can also be useful. The Downs cell will typically have a cylindrical brick-lined, steel casing. Cylindrical graphite anodes project upward through the bottom of the steel casing. Cylindrical steel cathodes project upward surrounding the anodes. In operation, the alkali metal is deposited on the inside surface of the steel cathodes and halogen gas is liberated at the graphite anodes. Typically, in a cell with four electrodes, the halogen is collected from the anodes into a gas dome from which the halogen exits the cell. The alkali metal rises in the electrolyte from the cathodes and is collected in a single compartment "collector ring" covering all four cathodes.

To prevent back-mixing and reaction of the alkali metal and halogen, a hydraulically permeable diaphragm, such as a steel mesh screen, is used to separate the cathode and anode compartments.

The following example is provided to further illustrate the invention and are not to be construed to unduly limit the scope of the invention.

EXAMPLE

This example shows that the process of the invention produces more sodium per cell than a process using the conventional process.

A conventional Downs electrolysis cell for sodium production was used. A dry salt mixture of 27 wt % NaCl and 73 wt % $SrCl_2$ was melted in the Downs cell and electrolyzed for 11 days, without any sign of sodium fog formation, at a cell voltage of 6.8 to 7.2 V, at a cell temperature of 610 to 615° C. and using a very high current density of about 7.5 $kA/m^2$ corresponding to a total cell current of 55,000 A. Cell output of sodium metal was about 2100 lbs (954.5 kg) per day which is about 20% to 25% higher than for the same type of Downs cell using conventional $NaCl/CaCl_2/BaCl_2$ electrolyte and using 45,000 A total current corresponding to about 6 $kA/m^2$ current density. Sodium made with the $NaCl/SrCl_2$ electrolyte was found to be of very high purity. After the usual sodium filtration step the chemical analysis showed less than 20 ppm Ca, less than 10 ppm Ba and less than 300 ppm of Sr.

The present invention is, of course, in no way restricted to the specific disclosure of the specification and drawing, but also encompasses any modifications within the scope of the appended claims.

What we claim is:

1. An electrolysis process for producing an alkali metal comprising carrying out said process at a current density in the range of from about 7 to about 10 $kA/m^2$ and in an electrolyte comprising an alkali metal halide and a strontium halide.

2. A process according to claim 1, wherein said alkali metal halide is sodium chloride.

3. A process according to claim 2, wherein said strontium halide is strontium chloride.

4. A process according to claim 3, wherein said process is carried out at a current density in the range of from about 7 to about 8 $kA/m^2$.

5. A process according to claim 2, wherein said process is carried out at a current density in the range of from about 7 to about 8 $kA/m^2$.

6. A process according to claim 1, wherein said strontium halide is strontium chloride.

7. A process according to claim 6, wherein said process is carried out at a current density in the range of from about 7 to about 8 $kA/m^2$.

8. A process according to claim 1, wherein said process is carried out at a current density in the range of from about 7 to about 8 $kA/m^2$.

* * * * *